United States Patent [19]

Miller et al.

[11] Patent Number: 4,556,476

[45] Date of Patent: Dec. 3, 1985

[54] METHOD FOR MINIMIZING FOULING OF HEAT EXCHANGER

[75] Inventors: Richard F. Miller, Humble; Michael P. Nicholson, Houston, both of Tex.

[73] Assignee: Atlantic Richfield Company, Los Angeles, Calif.

[21] Appl. No.: 639,896

[22] Filed: Aug. 10, 1984

[51] Int. Cl.[4] ..... C10G 9/16

[52] U.S. Cl. ..... 208/48 AA; 585/950; 252/47; 252/475

[58] Field of Search ..... 208/48 AA; 252/47, 47.5; 585/950

[56] References Cited

U.S. PATENT DOCUMENTS

| | | | |
|---|---|---|---|
| Re. 26,330 | 1/1968 | Colfer | 208/48 AA |
| 2,469,469 | 5/1949 | Kluge et al. | 208/48 AA |
| 2,587,660 | 3/1952 | Smith | 252/47.5 |
| 3,366,702 | 1/1968 | Moriarty | 208/48 AA |
| 3,539,515 | 11/1970 | McCabe | 252/47 |
| 3,557,232 | 1/1971 | Starnes, Jr. | 208/48 AA |
| 3,654,129 | 4/1972 | Bloch | 208/48 AA |
| 4,440,625 | 4/1984 | Go et al. | 208/48 AA |
| 4,465,881 | 8/1984 | Miller et al. | 585/4 |

FOREIGN PATENT DOCUMENTS

| | | | |
|---|---|---|---|
| 0662698 | 5/1979 | U.S.S.R. | 208/48 AA |

*Primary Examiner*—William R. Dixon, Jr.
*Assistant Examiner*—Cynthia A. Prezlock
*Attorney, Agent, or Firm*—Coleman R. Reap

[57] ABSTRACT

Hydrocarbon processing equipment is protected against fouling during the processing of hydrocarbons at elevated temperatures by adding to the equipment small amounts of mixtures of N,N'-dimer of phenothizine or substituted phenothiazine and one or more N,N diaromatic substituted hydroxylamines.

5 Claims, No Drawings

METHOD FOR MINIMIZING FOULING OF HEAT EXCHANGER

FIELD OF INVENTION

This invention relates to antifoulants and to a method of inhibiting fouling in petroleum or petroleum derivative processing equipment by injecting an antifoulant composition into a feed stream of the material being processed.

RELATED CASES

U.S. application Ser. No. 530,295, filed 9/8/83, relates to the use of mixtures of N,N'-dimers of phenothiazine and N,N'-diarylhydroxylamines to prevent the undesired polymerization of vinyl aromatic compounds.

BACKGROUND

Fouling of heat transfer surfaces of petroleum processing equipment occurs continuously during the period when petroleum or its derivatives are being processed in the equipment. The fouling is caused by the gradual buildup of a layer of high molecular weight polymeric material resulting from the thermal polymerization of unsaturated materials which are present in the petroleum. As time goes by, fouling continues with the attendant loss of heat transfer until finally the point is reached where it becomes necessary to take the equipment out of service for cleaning. Cleaning is expensive and time consuming; consequently, methods of preventing fouling, or at least significantly reducing the rate of fouling, are constantly being sought.

The most economical method of reducing the fouling rate in process heat transfer equipment is to add chemicals which inhibit fouling, called "antifoulants", to the feed stream being processed. Among the more interesting classes of chemical compounds which exhibit antifoulant activity are the phenothiazines. Their use to inhibit polymerization has been described in several patents.

PRIOR ART

U.S. Pat. Nos. 4,061,545 and 4,177,110 issued to Watson, disclose the use of a combination of tertiarybutylcatechol and phenothiazine as a polymerization inhibitor system for vinyl aromatic compounds. U.S. Pat. No. 3,539,515, issued to McCabe, discloses the use of phenothiazine dehydrocondensates as antioxidants for lubricating oils. The phenothiazine dehydrocondensates are prepared by reacting phenothiazine or a substituted phenothiazine with an organic peroxide. U.S. Pat. No. 3,148,225, issued to Albert, employs dialkyhydroxylamines for inhibiting popcorn polymer formation in styrenebutadiene rubbers. The dialkylhydroxylamine compounds appear to react with and terminate free radicals which cause undesired formation of polymers. U.S. Pat. No. 2,965,685, issued to Campbell, discloses inhibiting polymerization by adding about 5 ppm to 5 percent dialkylhydroxylamine to styrene monomer. Sato et al, in U.S. Pat. No. 3,849,498, teach the use of diethylhydroxylamine as a polymerization inhibitor for an alcoholic solution of unsaturated aldehydes. Mayer-Mader et al, U.S. Pat. No. 3,878,181, employ diethylhydroxylamine either alone or in combination with a water-soluble amine such as triethanolamine to terminate the aqueous emulsion polymerization of chloroprene. U.S. Pat. No. 3,426,063 discloses the use of N-nitrosoaralkylhydroxylamines to inhibit thermal polymerization of ethylenically unsaturated hydrocarbons.

It has now been discovered that mixtures of N'N'-dimers of phenothiazine or substituted phenothiazine and N,N-diaromatic-substituted hydroxylamine provide outstanding antifoulant protection for petroleum or petroleum derivative processing equipment. Thus, because of the synergistic effect of these mixtures it is now possible to provide unexpectedly superior antifoulant protection with the same total equivalent weight of mixtures of the N,N'-dimers of phenothiazine or substituted phenothiazines and N,N'-diaromatic-substituted hydroxylamines than is obtainable by the use of members of either of these groups of compounds by themselves.

Accordingly, it is an object of the invention to present a method of enhancing the antifouling protection of petroleum processing equipment. This and other objects of the invention are set forth in the following description and examples of the invention.

SUMMARY OF THE INVENTION

The improved antifoulant compositions used in the invention are comprised of mixtures of at least one N,N'-dimer of phenothiazine or a substituted phenothiazine and one or more N,N-diaromatic-substituted hydroxylamine. In a preferred embodiment of the invention the antifoulant is dissolved in an organic solvent and the resulting solution is continuously injected into a stream of petroleum at a point which is upstream from the equipment which is to be protected.

DETAILED DESCRIPTION OF THE INVENTION

The N,N'-dimers of phenothiazine or the substituted phenothiazines most useful in the invention have the structural formula

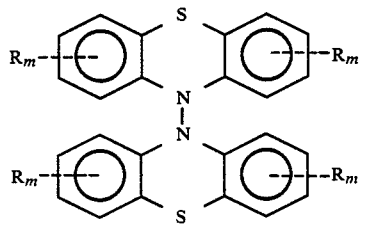

wherein m is an integer of 0 to 4, i.e. there may be from 0 to 16 R substituents on each molecule of the dimer, and some or all of the R's may be identical or all of the R's may be different. In the preferred embodiment the m's are integers having values of 0, 1 or 2. Each R may be a halogen atom or an unsubstituted or a halogen-substituted alkyl group having 1 to 20 and preferably 1 to 6 alkyl carbon atoms.

When all of the m's in the above structural formula are 0, the compound is the N,N'-dimer of phenothiazine. This is the preferred dimer for use in the invention since unsubstituted phenothiazine is less expensive as a starting material than the substituted phenothiazines. In an alternate embodiment the m's may be integers of 1 to 4, in which case the compound is a dimer of an alkyl-substituted or haloalkyl-substituted derivative of phenothiazine. Typical hydrocarbon alkyl substituents include methyl, ethyl, isopropyl, butyl, hexyl decyl, hexadecyl, etc. groups. There may be up to 4 such substituents on each benzene ring portion of the dimer. Since the dimer contains 4 benzene nuclei there may be up to 16 identical or different substituents. If all of the phenothiazine component starting material is phenothiazine or a single derivative of phenothiazine, the dimer is composed of two identical moieties. However, if the phenothiazine component starting material is composed of two or more different phenothiazine derivatives a mixture of products would result some of which could have 16 different substituents if the monomeric starting materials had all dissimilar substituents.

Typical phenothiazine dimers are 10,10'diphenothiazine; 1,1'-dimethyl-10,10'diphenothiazine; 2,6,2',6'-tetramethyl-10,10'-diphenothiazine; 2,2'-dimethyl-8,8'-dipropyl10,10'diphenothiazine; 3,4'-dimethyl,6,7'dihexyl-10,10'diphenothiazine; 2,2'-dichloro-10,10'-diphenothiazine; 3,3',7,7'tetrabromo-10,10'-diphenothiazine; 4,4'-bis(2-chloroethyl)-10,10'-diphenothiazine; 3,3',6,6'-tetrakis(4-flourobutyl)-10,10'-diphenothiazine; 1,1',2,2',3,3',4,4',6,6',7,7',8,8',9,9'-hexadecylmethyl-10,10'-diphenothiazine; etc. From the standpoint of preparation, cost and utility, the preferred phenothiazine dimers are phenothiazine dimer and the alkyl-substituted phenothiazine dimers having up to two substituents on each benzene nucleus, each substituent having 1 to 4 carbon atoms in each alkyl group. Examples of preferred substituted phenothiazine dimers are 1,1'-dimethyl-10,10'-diphenothiazine; 2,2'-dimethyl-4,4'-diethyl-10,10'-diphenothiazine; 2,2',6,6'tetramethyl-3,3'-diethyl-10,10'-diphenothiazine, etc.

The term "phenothiazine component" as used herein represents phenothiazine or any of the substituted phenothiazines in the above definition.

Phenothiazine and some hydrocarbon-substituted phenothiazines are available commercially. Others may be prepared by well-known techniques, such as alkylation. The preparation of the phenothiazine component forms no part of the invention.

The phenothiazine dimers used in the invention are prepared by heating the phenothiazine component in the presence of an organic peroxide. The optimum reaction temperature employed will vary depending upon the particular phenothiazine compound used as the starting material and the particular organic peroxide used. In general, temperatures in the range of about 25° to 300° C. are effective to produce the desired result.

Any of the common organic peroxides can be used to effect the dimerization. The peroxide chosen will depend upon the desired reaction temperature. Typical organic peroxides include benzoyl peroxide, lauroyl peroxide, ditertiary-butyl peroxide, tertiary-butyl hydroperoxide, tertiary-butyl peroctoate, acetyl peroxide, etc.

The amount of peroxide present in the reactor relative to the amount of phenothiazine component in the reactor will determine the rate of reaction. Usually it is preferred to add the peroxide to the reactor containing the charge of phenothiazine component at a controlled rate to maintain the reaction speed at the desired rate. The amount of peroxide in the reactor is usually maintained in the range of about 1 to 50 mole percent and preferably in the range of about 5 to 25 mole percent, based on the total number of moles of phenothiazine component present in the reactor.

The dimers can be prepared by heating the phenothiazine component and organic peroxide directly, but, since the phenothiazine component and many organic peroxides are solid, it is usually preferable to carry out the reaction in the presence of a solvent or diluent. Typical diluents include the lower alkanes; petroleum distillate; kerosene, such as methyl ethyl ketone; aldehydes, such as benzaldehydes, etc. Ideally the solvent or diluent is a substance which will not interfere with the intended end use of the product so that there will be no need to recover the dimer from the solvent or diluent prior to the end use. When the reaction is carried out in the presence of a solvent or a diluent, the solvent or diluent is generally present in amounts of about 70 to 97%, based on the total weight of components in the reaction mixture.

In a typical procedure for preparing the dimers used in the invention the phenothiazine component and solvent or diluent are charged to a suitable reactor. The desired amount of organic peroxide is then charged to the reactor and the reactor contents are heated to the reaction temperature. If desired, the reaction may be carried out under a nitrogen blanket. As the peroxide is consumed additional peroxide is added to the reactor, either continuously or incrementally, at a rate to control the progress of the reaction. Since the reaction is exothermic, it may be necessary to cool the reactor during the course of the reaction. It is usually complete in about 2 to 24 hours, depending, of course, on the reaction conditions. Excess peroxide may be added to the reactor to ensure that all of the phenothiazine component is reacted. Upon completion of the reaction, the product may be recovered from the solvent or used as is.

Phenothiazine and some hydrocarbon-substituted phenothiazines are available commercially. Others may be prepared by well-known techniques, such as alkylation. The preparation of the phenothiazine component forms no part of the present invention.

The N,N-diaromatic-substituted hydroxylamine compounds used in the invention have the structural formula

R'R''NOH wherein R' and R'' are the same or different aromatic hydrocarbon radicals having the structural formula

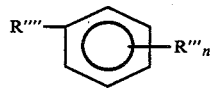

wherein R''' is a straight- or branched-chain alkylene radical having 1 to 10 carbon atoms, R'''' is hydrogen or a straight- or branched-chain alkyl group having 1 to 6 carbon atoms and n is 0 or 1. In preferred embodiments R' and R'' are phenyl or aromatic radicals as described above wherein R'' has 1 to 6 carbon atoms and R'''' is hydrogen. When n is 0, R''' does not exist and the phenylene group is attached to the nitrogen atom. Although N,N-diaromatic-substituted hydroxylamines having more than the above specified number of alkyl or alkylene carbon atoms in each aromatic substituent group may be useful in the invention it is preferred that compounds containing the above-stated upper limits be used in the invention because the latter compounds provide completely satisfactory results and they are easier to prepare. Mixtures of two or more of such diaromatic substituted hydroxylamines can also be advantageously used in the compositions of the invention.

Suitable diaromatic substituted hydroxylamines include N,N-diphenylhydroxylamine; N,N-dibenzylhydroxylamine; N-phenyl-N-(3-phenylpropyl)hydroxylamine; N,N-bis(2-methyl-8-phenyloctyl)hydroxylamine; N,N-bis[4-(1,1-dimethylethyl)phenyl]hydroxylamine; N,N-bis(3-hexylphenyl-4-butyl)hydroxylamine; N-phenyl-N-(4-ethylphenyl-2-ethyl)hydroxylamine; etc. Preferred diaromatic-substituted hydroxylamines include N,N-bis(3-phenylpropyl)hydroxylamine, etc. As noted above, two or more of these compounds may be used in combination, if desired.

Some N,N-diaromatic-substituted hydroxylamines are available commercially. Those N,N-diaromatic hydroxylamines which are not commercially available may be prepared by any of the well known techniques. The preparation of these compounds forms no part of the present invention.

The relative concentrations of the N,N' dimer of the phenothiazine component and N,N-diaromatic-substituted hydroxylamine used in the invention are generally in the range of about 10 to 90 weight percent of the N,N' dimer of the phenothiazine component and about 90 to 10 weight percent N,N-diaromatic-substituted hydroxylamine, based on the total combined weight of these components. In preferred embodiments the concentrations generally fall in the range of about 25 to 75 weight percent of the N,N' dimer of the phenothiazine component and 75 to 25 weight percent N,N-diaromatic-substituted hydroxylamine, based on the total combined weight of these components.

The antifoulant systems of the invention are particularly well suited for protecting the reboiler sections of a distillation column because of the high boiling point of the inhibitor compounds in the system. The antifoulant system may be used at temperatures up to about 400° C. or higher at atmospheric pressure. Since the boiling point of various members of each of the two classes of compounds, i.e. the N,N' dimers of the phenothiazine component and the N,N'-diaromatic-substituted hydroxylamines are different, compounds which have the desired boiling point can be easily selected from each class. In some cases it may be desirable to use lower boiling antifoulants in combination with the antifoulant of the invention. This can advantageously provide protection to the overhead portion of the column. It may also be desirable to add with the antifoulant system of the invention other agents, such as corrosion inhibitors, to provide additional protection to process equipment.

The antifoulant system of the invention can be introduced into the equipment to be protected by any conventional method. They are generally introduced just upstream of the point of desired application by any suitable means, such as by the use of a proportionating pump. It can be added to the feedstream as a single composition containing all of the desired antifoulant compounds, or the individual components can be added separately or in any other desired combination. The composition may be added as a concentrate, if desired, but it is preferable to add it as a solution which is compatible with the monomer being treated. Suitable solvents include kerosene, naphtha, the lower alkanes such as hexane, aromatic solvents, such as toluene, alcohols, polyols or ketone, etc. The concentration of antifoulant system in the solvent is desirably in the range of about 1 to 30 weight percent and preferably about 5 to 20 weight percent based on the total weight of antifoulant and solvent.

The antifoulant system is used at a concentration which is effective to provide the desired protection against hydrocarbon fouling. It has been determined that amounts of antifoulant in the range of about 0.5 to 1000 ppm based on the weight of the hydrocarbon feedstream being processed afford ample protection against undesired fouling. For most applications the antifoulant system is used in amounts in the range of about 1 to 500 ppm.

For the purpose of testing the effectiveness of antifoulant compositions thermal fouling determinations can be made using a Jet Fuel Thermal Oxidation Tester marketed by Alcor, Inc. The specifications of this apparatus are set forth in ASTM D3241-74T. In general the apparatus consists of reservoir to hold the hydrocarbon liquid being tested, an electrically heated tubular heater and a precision stainless steel filter. Tubular conduit connects the reservoir with the heater and the heater with the filter. Pressure gauges are provided for measuring the pressure drop across the filter. A thermocouple and a temperature controller are provided for precise control of the temperature of the liquid passing through the heater.

In operation, a hydrocarbon oil is pumped through the heater, which has adequate heat transfer surface to maintain the heater effluent at a predetermined temperature in the range of about 250° to 900° F. As the hydrocarbon passes through the heater a film of polymeric residue builds up on the inside of the heater. Particles of the residue slough off the surface of the heater tube and are caught in the filter. As the filter clogs up the pressure drop across the filter increases. The fouling rate in the heater is approximated by measuring the rate of pressure build-up across the filter. The test is terminated when the pressure drop reaches a predetermined value or when a predetermined time period expires. The equipment is dismantled and thoroughly cleaned after each run.

EXAMPLE

A series of antifoulant effectiveness tests can be conducted using various antifoulants. The tests can be carried out using a convenient hydrocarbon flow rate through the above-described heater, such as about 240 ml per hour and with the heater effluent temperature maintained at a suitable temperature, such as 600° F. The tests can be terminated at a predetermined time.

A comparison of a composition of the invention, such as a 50/50 weight percent mixture of 10,10'-diphenothiazine and N,N dibenzylhydroxylamine, with the same concentration of either component of this composition will show that the mixture is a significantly more effective antifoulant than either of the components used alone.

Although the invention is described with particular reference to specific examples, it is understood that the invention includes obvious variants. For example, the antifoulant system can be formulated to contain more than one dimeric derivative of phenothiazine. The scope of the invention is limited only by the breadth of the appended claims.

We claim:

1. In a method of inhibiting fouling of hydrocarbon processing equipment during the processing of hydrocarbons at elevated temperatures comprising introducing into the equipment an amount of an antifoulant agent effective to substantially reduce the rate of fouling, the improvement comprising using as the agent a composition comprised of:

(a) at least one member selected from the N,N' dimers of (1) phenothiazine, (2) halo-substituted phenothiazines, (3) alkyl-substituted phenothiazines and (4) haloalkyl-substituted phenothiazines, and (b) at least one hydroxylamine containing two N-substituted hydrocarbon groups each of which contains an aromatic radical.

2. In a method of inhibiting fouling of hydrocarbon processing equipment during the processing of hydrocarbons at elevated temperatures comprising introducing into the equipment an antifoulant agent effective to substantially reduce the rate of fouling, the improvement comprising using the agent a mixture of:

(1) at least one compound having the structural formula

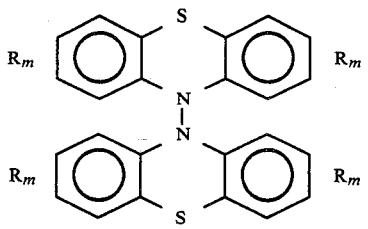

wherein the R's may be the same substituent or different substituents selected from alkyl groups having 1 to 20 carbon atoms, halogen atoms, halogen-substituted alkyl groups having 1 to 20 carbon atoms and mixtures of these and the m's may be the same integer or different integers in the range of 0 to 4, and (2) at least one compound having the structural formula

R'R''NOH wherein R' and R'' are the same or different hydrocarbon radicals having the structural formula

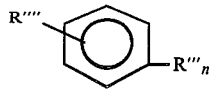

wherein R''' is an alkylene radical having 1 to 10 carbon atoms, R'''' is hydrogen or an alkyl group having 1 to 6 carbon atoms and n is 0 or 1.

3. The process of claim 2 wherein the total concentration of the compounds in (1) and (2) added to said hydrocarbon processing equipment is 0.5 to 1000 ppm, based on the total weight of hydrocarbon being processed in the equipment and the relative concentration of the compounds in (1) and (2) are 90 to 10 parts by weight and 10 to 90 parts by weight respectively.

4. The process of claim 2 wherein the m's are the same or different integers selected from 0, 1 and 2, each R is an alkyl group having 1 to 6 carbon atoms, R''' has 2 to 6 carbon atoms, the relative concentrations of the compounds in (1) and (2) are 25 to 75 parts by weight and 75 to 25 parts by weight respectively and the total concentration of the compounds in (1) and (2) in said hydrocarbon processing equipment is 1 to 500 ppm, based on the total weight of hydrocarbon being processed.

5. The process of claim 1 wherein the compound in (1) is 10,10'-diphenothiazine and the compound in (2) is N,N'-dibenzyl-hydroxylamine.

* * * * *